United States Patent [19]

Laufhütte

[11] 4,123,331

[45] Oct. 31, 1978

[54] METHOD OF KEEPING THE CIRCULATING SPRINKLING WATER FOR THE UPTAKES OF COKE OVENS CLEAN

[75] Inventor: Dieter Laufhütte, Recklinghausen, Germany

[73] Assignee: Firma Carl Still Recklinghausen, Germany

[21] Appl. No.: 753,683

[22] Filed: Dec. 23, 1976

[30] Foreign Application Priority Data

Jan. 3, 1976 [DE] Fed. Rep. of Germany ..... 2600130

[51] Int. Cl.[2] ..... C10B 27/04

[52] U.S. Cl. ..... 201/4; 201/40; 201/41; 202/254; 208/39

[58] Field of Search ..... 201/2, 4, 29, 40, 41; 202/254, 256, 258, 263, 241, 255; 208/39, 48 R

[56] References Cited

U.S. PATENT DOCUMENTS

| | | | |
|---|---|---|---|
| 1,924,163 | 8/1933 | Miller | 208/39 X |
| 2,976,230 | 3/1961 | Emery et al. | 208/8 |

FOREIGN PATENT DOCUMENTS

| | | | |
|---|---|---|---|
| 283,233 | 12/1970 | U.S.S.R. | 208/39 |

*Primary Examiner*—Morris O. Wolk
*Assistant Examiner*—Arnold Turk
*Attorney, Agent, or Firm*—McGlew and Tuttle

[57] ABSTRACT

Method of keeping sprinkling water used for sprinkling in the uptakes of coke ovens in a clean condition, comprises directing the sprinkling water condensate which is collected after circulation in the uptakes, and which includes tar, tar oils, hydrocarbons and ammonia, into a separator to separate a clean sprinkling liquid therefrom, and returning this liquid to the flue and also directing a tar which is free of solids into the flue with the sprinkling liquid, at least during an initial period of operation of the coking oven.

3 Claims, 1 Drawing Figure

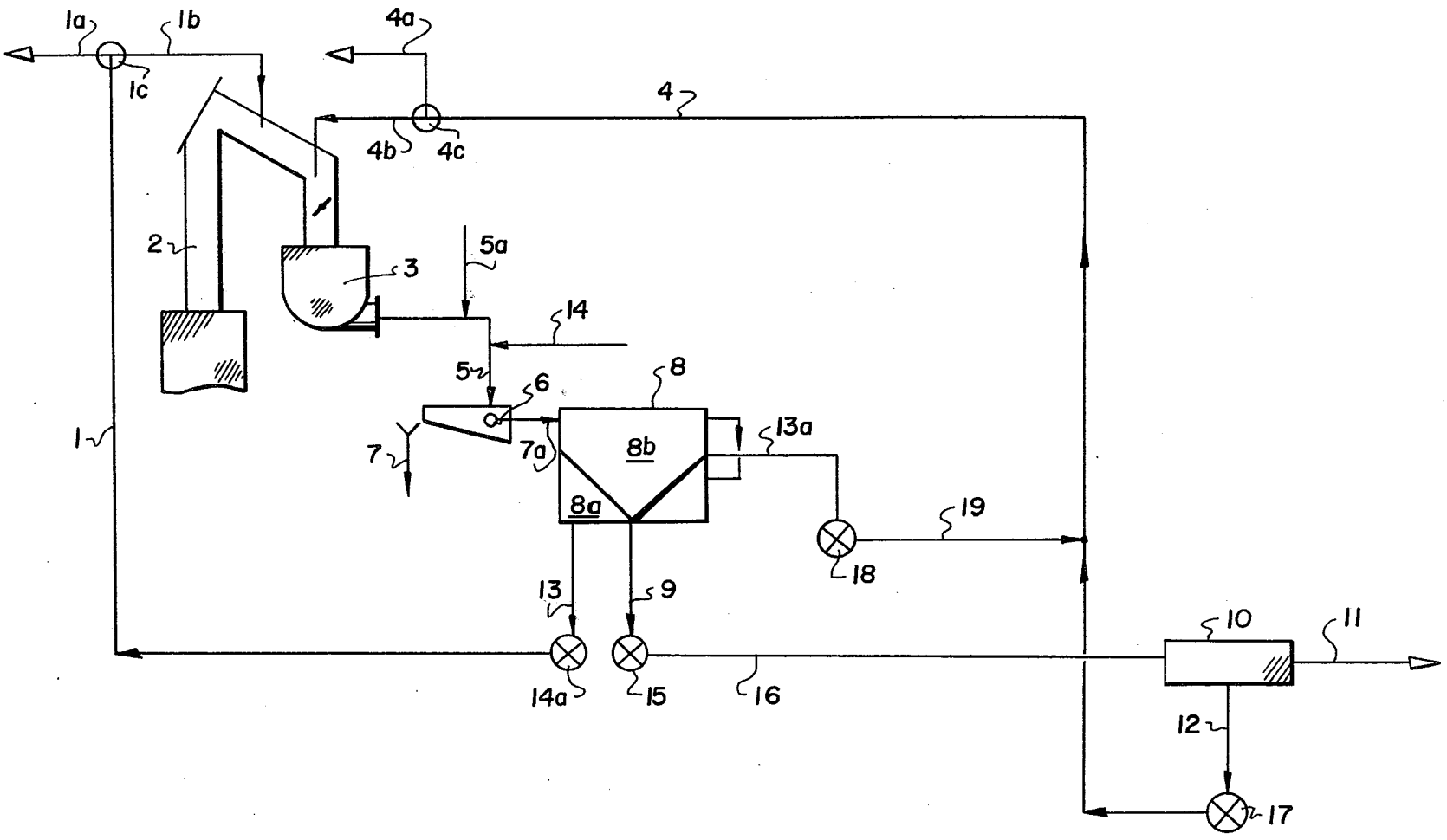
1a
1b
1c
1
2
3
4
4a
4b
4c
5
5a
6
7
7a
8
8a
8b
9
10
11
12
13
13a
14
14a
15
16
17
18
19

METHOD OF KEEPING THE CIRCULATING SPRINKLING WATER FOR THE UPTAKES OF COKE OVENS CLEAN

FIELD AND BACKGROUND OF THE INVENTION

This invention relates in general to the construction of coke ovens and, in particular, to a new and useful method of operating the sprinkling system of a coke oven flue, which includes collecting the condensate of a sprinkling liquid from the flue along with tar, tar oils, hydrocarbons and ammonia, and directing it into a separator to separate out a sprinkling liquid from the condensate and returning the sprinkling liquid to the condensate along with a tar free of solids, at least during an initial period of operation of the coking oven.

DESCRIPTION OF THE PRIOR ART

The invention concerns a method for keeping the circulating sprinkling water for the uptakes of coke ovens clean, in which the sprinkling water is injected into the uptakes of the oven chambers; is separated again from the discharge of the collecting mains containing tar, tar oils and hydrocarbons, and is returned into the uptakes of the coking ovens. The sprinkling water serves, by its partial evaporation, to cool and condense the crude coke oven gases which are saturated with steam. Fine solid particles, together with the crude hot gas, pass from the coal into the uptakes during the filling of the oven chambers at least at the beginning of the coking process, and from there into the collecting mains and possible into the precooling system, and their amount depends substantially on the preliminary treatment of the coking coal, for example, in respect to whether, and to what extent, it has been ground, predried and preheated.

When the bulk of the coal is ground to a particle size of between 1 to 3 mm, and a water content of 8 to 10%, the solid portion passing over with the crude gas remains within limits, is normally absorbed primarily by the condensate, and accumulates in the tarry condensate portion and remains there during the known separation of tar and water by decantation, so that a clear water is obtained which can be readily pumped back into the uptakes. Excess water or so-called water of formation, which is formed during the coking, must be freed of harmful substances before it can be transferred to the draining canal. About 2 to 5% water and about 10% solids remain in the tarry phase. Such a solid portion does not interfere with the separation of tar and water.

It is known that the tar-water separation becomes increasingly difficult with rising solid content of the total condensate, until finally mixtures of tar water and solid particles are obtained which can no longer be separated by simple technical means. The separation is only possible mechanically by means of centrifuging or evaporation of the water. Hence, there is a distillation or dilution with tar oils and filtration. In any case, much energy must be expended for this method of separation, and elaborate equipment is required.

The solid portion of the entire coke oven gas is only slightly increased by filling gases, if a filling method with filling gas exhaust through the uptakes is used and the cooling coal has not been finely ground, nor predried, nor preheated.

The solid portion, is in any case, substantially increased during the filling of the coking coal at the beginning of the coking process, if the coking coal is finely ground, predried and preheated. A simple and complete separation of tar and water is then no longer possible by decantation, and an aqueous phase is obtained which is full of tar and solid particles and which lends to clogging of the perforated pipes and pumps. Under these circumstances, the preparation of a pumpable sprinkling water from the plant itself can no longer be ensured. In addition, this leads to deposits of solid particles and to clogging of the receivers and crude gas pipes. The solid portions penetrate into the precoolers and gas exhausters, where they lead to the formation of crusts and deposits and to clogging, imbalances, etc.

Elaborate technical means and much energy is required for separating the mixtures of tar water and solid particles formed in the condensation which are difficult to separate and a risk for the parts of the plant behind the precoolers is by no means eliminated.

SUMMARY OF THE INVENTION

The object of the invention is therefore to find and to suggest within the framework of a method of the above-described type, particularly with temporarily increased formation, changing from oven chamber to oven chamber, of crude gas highly contaminated with solid particles, a method for separating water and tar, which is technically perfect, well-arranged and less elaborate as far as operating media, equipment and energy are concerned.

The solution of the problem provides that tar, free of solids as far as possible, is injected into the uptakes of the oven chamber and finely distributed during the filling of the coal into the oven chambers as well as in the initial coking period, or only in the initial coking period.

Due to the injection of purified tar into the uptake during the time of increased entrainment of the solids by the filling gases and the hot crude coke oven gas, the ratio of tar to solid in the total condensate increases, and after the preliminary separation of the thick tar, a satisfactory water-tar separation is achieved in a conventional decantation-tar separator, so that the clear sprinkling water free of tar components, is available in sufficient amounts for the uptakes. The separation is not enhanced, however, by increasing the amount of the injected water.

Accordingly, it is an object of the invention to provide a method of operating a coke oven flue sprinkling system to ensure clean sprinkling water, which comprises, directing the sprinkling water condensate which includes tar, tar oils, hydrocarbons and ammonia into a separator and separating a sprinkling liquid from the condensate and returning it to the flue and directing a tar, free of solids, into the flue along with the sprinkling liquid, at least during an initial period of operation of the coking oven, and possibly also during the filling of the coal into the oven chambers.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

BRIEF DESCRIPTION OF THE DRAWING

The only FIGURE of the drawing is a schematic representation of a system for carrying out the method of operating a coking oven flue sprinkling system to ensure clean sprinkling water in accordance with the invention.

DESCRIPTION OF THE PREFERRED EMBODIMENT

Generally, it was found that it suffices to effect the injection of the tar into the uptakes in the first 15 to 60 minutes of the coking process, and that from 1-to 5-times the amount of tar to that of sprinkling water by weight must be injected per oven chamber. The number of uptakes of oven chambers to be sprayed simultaneously with the tar depends on the injection time, and is 2 to 8 chambers for a battery of 85 oven chambers and a coking period of, for example, 12 hours.

According to the invention, substantially more tar must be separated from the water, but it has the effect that the solid portions from the crude hot gas is absorbed so early and to such an extent by the injected tar and the total condensate that they do not penetrate into the following sensitive parts of the plant, such as precoolers and gas exhausters, and the solid portion is kept so low in the total condensate that a satisfactory separation of tar and water takes place in the tar separator.

The tar obtained in the precoolers can also be included in the process and, preferably, it is fed into the line leading to the thick tar separator. Tars of other coking batteries which are obtained relatively pure can also be used for the new method.

The tar of one's own plant is subjected to a careful preparation for injection into the uptakes. As far as possible, it is freed of solids in a known manner by washing, centrifuging or distillation, and then fed to the uptakes.

It is not possible to predict the maximum portion which the solids in the tar phase may not exceed, so that the satisfactory water-tar separation in a tar separator is not jeopardized, because a plurality of phenomena, partly of a colloid-chemical nature, play a role which is difficult or impossible to overlook. The fineness of the solid particles is important, however, in general, starting from the consideration that 20% solid portions should not be exceeded, but higher percentual portions are also tolerable.

No general purity limit can be indicated either for the tar flowing to the uptakes, although 5% solid portions is generally desirable as an upper limit.

Several combinations are possible with regard to the tar flow in batteries operated conventionally with wet coal and those with dry, preheated coal, but it is only important that a low solid content is preserved in the tar flowing to the uptakes. For fine atomization, known nozzles are attached on the atomization lines.

Referring to the drawing in particular, the device indicated therein, comprises a coking battery with 85 oven chambers, each of which have an uptake on the machine-and coke side, and the respective collecting mains. It has a coking time of 12 hours and is operated with predried and preheated coal. For the sake of clarity, only one side of an oven chamber (coke side) of the battery and the connecting lines to the other side (machine side) are shown. 600 $m^3$ sprinkling water per hour are fed through line 1, distributor line 1*c*, as well as the injection lines 1*a* and 1*b* to the uptakes 2 on both sides, and thus to the collecting mains 3, hence a total of 1200 $m^3$ per hour, that is, 117 liters per uptake per minute or 234 liters per oven chamber per minutes.

A total of 4.5 *t* crude tar and 5 *t* solids (coal dust) arrive per hour through the 170 uptakes 2 of the total battery in the two collecting mains 3. 100 *t* tar with 10 *t* water, as well as 4.5 *t* solids flow per hour through line 4, distributor line 4*c* and tar injection lines 4*a* and 4*b*, into the collecting mains 3, through several uptakes additionally. The injection time through lines 4*a* and 4*b* is 40 minutes, that is, at any time five uptakes 2 each of five oven chambers are fed with tar at any time on each side. The amount per uptake is 165 1 per minute. It is sufficient to wet, bind and absorb together with the tar obtained during the coking the increased solid portion during the filling period and the first 40 minutes of the coking period. A total of 1200 $m^3$ water containing the water of formation of the coking process, and 104.5 *t* crude tar with a solid portion of 9.5 *t* are discharged per hour through lines 5 and 5*a*. Included in this amount of tar are 2 *t* from the precoolers added through line 14.

In the thick tar box 6, this tar is separated from the water-tar mixture and discharged through line 7. The thick tar can be added to the coking coal and be returned in the oven chambers. The water-tar mixture is discharged through line 7*a* and conducted into the water-tar separator 8 of a known design (e.g., according to German Pat. No. 1,057,721). At this point, sufficiently clean water, suitable for sprinkling the uptakes, is separated in chamber 8*a* and is withdrawn through line 13 and returned through pump 14*a* and line 1 to the uptakes 2. Tar is withdrawn from chamber 8*b* of the water-tar separator 8 with a low water content and the entire solid content through line 9, and is fed through pump 15 and line 16 to centrifuge 10. Tar liberated of solids is withdrawn in an amount of 100 *t* per hour through line 12 and fed through pump 17 and line 4 to the uptakes. 4.5 *t* tar and 5 *t* solids are withdrawn per hour through line 11.

The mixture is either burnt, coked or prepared according to known methods and separated into tar and solid. If necessary, a water-tar mixture free of solids from chamber 8*b* of the water-tar separator can be added through line 13*a*, pump 18 and line 19 to the tar from line 4, in order to have a sufficient amount of liquid available during the first minutes of the coking process, for example, for the absorption of the particularly large amount of solids from the oven chambers.

While a specific embodiment of the invention has been shown and described in detail to illustrate the application of the principles of the invention, it will be understood that the invention may be embodied otherwise without departing from such principles.

What is claimed is:

1. A method of keeping the circulating sprinkling water which is delivered to the gas uptake of coke ovens clean, comprising directing sprinkling water to the uptake of the coke ovens and spraying it into the uptake, condensing and collecting a sprinkling water condensate from the uptake after it has cooled the gases flowing upwardly therein and picked up a quantity of tar, tar oils, hydrocarbons and solids, directing the sprinkling water condensate into a water-tar separator to separate out a sprinkling liquid from the condensate, directing the separated sprinkling liquid to the uptake, directing a tar which is substantially free of solids in an amount of from one to five times the amount by weight of the separated sprinkling liquid into the uptake along with the separated sprinkling liquid at least during the filling of the coke oven with coal and the start of a coking process which is a time of increased solid particle contamination in the uptake gases to form a tar-sprinkling water condensate, separating a thick-tar from the tar-sprinkling water condensate, and directing tar-sprinkling water condensate from the thick-tar separator to the water-tar separator, whereby during said period of increased solid particle contamination the ratio of tar to solids in the uptake gases is increased to permit the thick-tar separation so that a subsequent tar-water separation may take place.

2. A method according to claim 1, wherein the tar directed into the uptake during increased solids contamination is collected from another one of the coking oven batteries.

3. A method according to claim 1, wherein the injection of tar with the separated sprinkling liquid takes place during the initial 15 to 60 minutes of the coking process.

* * * * *